United States Patent [19]

Jimenez

[11] 4,018,173

[45] Apr. 19, 1977

[54] DEVICE COMPRISING TWO PIECES HELD TOGETHER IN SPACED APART RELATION BY JOINING ELEMENTS

[75] Inventor: Antonio Jimenez, Meyrin-Geneva, Switzerland

[73] Assignee: Mefina S.A., Fribourg, Switzerland

[22] Filed: Dec. 10, 1975

[21] Appl. No.: 639,432

[30] Foreign Application Priority Data

Dec. 19, 1974 Switzerland ..... 16989/74

[52] U.S. Cl. ..... 112/231

[51] Int. Cl.[2] ..... D05B 57/14

[58] Field of Search ..... 112/228, 229, 230, 231, 112/181, 189, 184

[56] References Cited

UNITED STATES PATENTS

| | | | |
|---|---|---|---|
| 18,605 | 11/1857 | Smith | 112/189 |
| 1,091,062 | 3/1914 | Hohmann | 112/181 |
| 1,181,160 | 5/1916 | Parkes | 112/181 |

FOREIGN PATENTS OR APPLICATIONS

| | | | |
|---|---|---|---|
| 26,211 | 3/1907 | Switzerland | 112/201 |
| 3,455 | 2/1910 | United Kingdom | 112/189 |

*Primary Examiner*—George H. Krizmanich
*Attorney, Agent, or Firm*—Emory L. Groff, Jr.

[57] ABSTRACT

A bobbin carrier of a sewing machine is suspended in a surrounding plate solely by several radial pins bridging the space between the carrier and the plate and which can be successively temporarily retracted from the space by a rotating cam. A hook turning with the cam takes up thread from a needle and drives it about the bobbin carrier, in synchronization with retraction of the pins, for the formation of a stitch with a thread fed from a bobbin in the carrier.

7 Claims, 8 Drawing Figures

DEVICE COMPRISING TWO PIECES HELD TOGETHER IN SPACED APART RELATION BY JOINING ELEMENTS

The invention concerns a device comprising two pieces spaced apart from one another and held to one another by joining elements which are movable to allow another element to pass in the space comprised between the two pieces.

Such devices may, in particular, be for suspending the bobbin carrier of a sewing machine in a surrounding piece fixed to a lower part of the frame of the sewing machine under a needle-hole plate, in which the momentaneous and successive retraction of the joining elements upon driving of a loop of upper thread about the bobbin carrier by a rotary or oscillating hook permits engagement of the upper thread with a lower thread fed from a bobbin in the bobbin carrier for the formation of a stitch.

The accompanying drawings show, schematically and by way of example, two embodiments of the invention. In the drawings.

Figure 1:
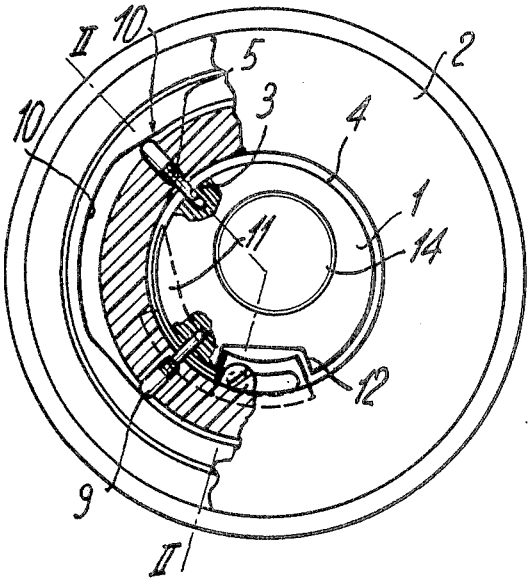
FIG. 1 is a partly cut-away top plan view of a first embodiment.
Figure 2:
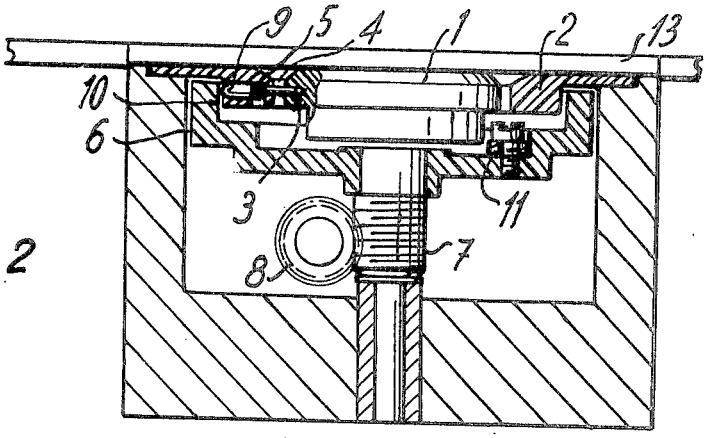
FIG. 2 is a cross-section along line II—II of FIG. 1.
Figure 3:
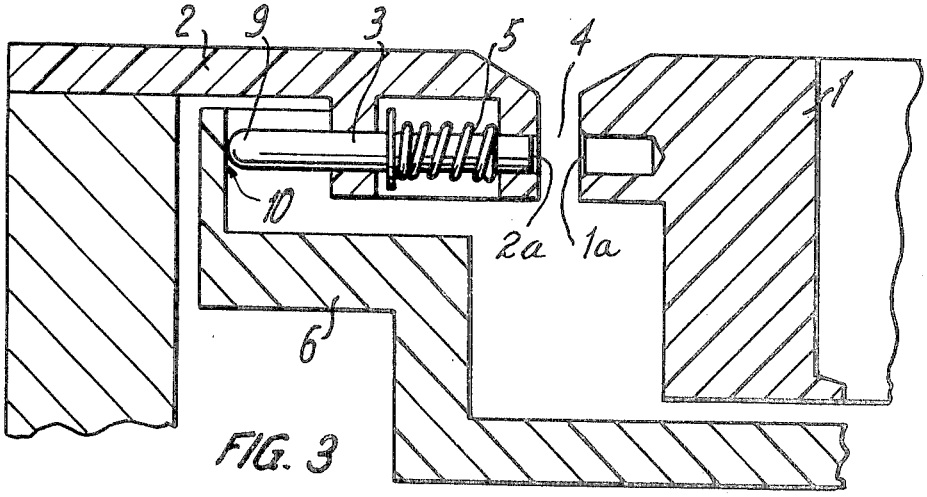
FIG. 3 is an enlarged scale cross-section showing a joining element of FIGS. 1 and 2 in the retracted position.
Figure 4:
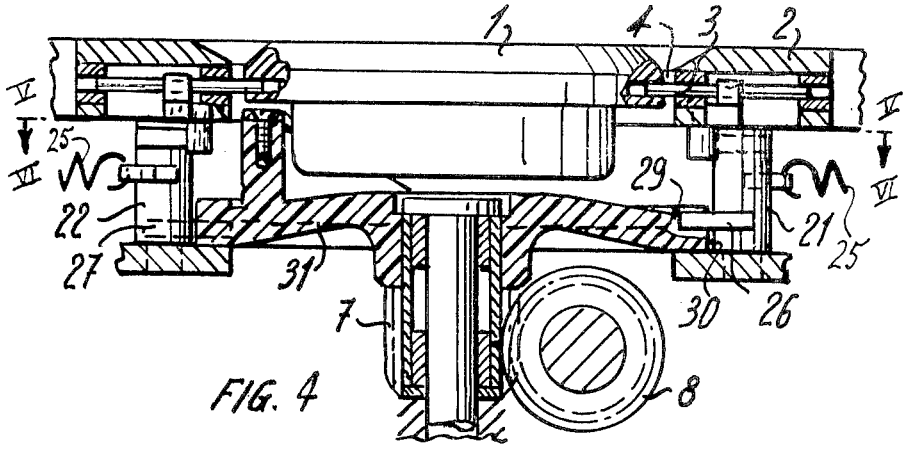
FIG. 4 is an elevational view, partly in axial cross-section, of a second embodiment.

The embodiment of FIGS. 1 to 3 comprises a bobbin carrier 1 of a sewing machine, suspended in a surrounding plate 2 by means of four pins 3 passing through and on either side of an annular space 4 and mounted in facing radial bores 12 and 22 of bobbin carrier 1 and plate 2 respectively. A biasing spring 5 tends to hold each pin 3 retracted in plate 2 (see FIG. 3). A rotary dish-like part 6 integral with a pinion 7 meshing with a worm screw 8 driven by the principal driving shaft of the machine is mounted spaced-apart under the bobbin carrier 1 and its surrounding plate 2. At its periphery, part 6 has an upstanding wall provided on its inner upper edge, facing the outer ends 9 of pins 3 opposite the ends which engage in the radial bores of bobbin carrier 1, with a cam profile 10 normally holding three of the pins 3 engaged in their radial bores in bobbin carrier 1, whereas the fourth pin is retracted in the plate 2 (FIG. 3). A hook 11 is mounted on the bottom of dish-like part 6 below the annular spaces 4, with a pointed end facing in the direction of rotation of part 6 and disposed adjacent the part of cam profile 10 which allows retraction of a pin 3 from the corresponding radial bore of bobbin carrier 1.

Hence, when the dish-like part 6 is rotated by the principal shaft of the machine, the four pins 3 are individually and successively retracted from the annular space 4 between the bobbin carrier 1 and its surrounding plate 2.

The bobbin carrier 1 has a notch 12 in its edge disposed under the needle hole of needle-hole plate 13. Hence, each time the needle of the machine penetrates in this hole, the upper thread in the needle is taken up by the hook 11 which passes it around the bobbin carrier 1 to wind it about a lower thread fed from the bobbin 14 in carrier 1.

In relation to the usual rotary-hook shuttle devices, this device has the advantage that the bobbin carrier 1 is entirely independent of the dish-like part 6 carrying hook 11, which eliminates any friction between these two parts. The "escapement" provided in the usual devices to fix the bobbin carrier in relation to the rotary hook is replaced by the pins 3 controlled by cam profile 10, with which there is practically no risk of tangling the threads during formation of the stitches.

It has however been observed that in rotary or reciprocating shuttle devices, the passage of the loop between the surrounding plate and the bobbin carrier tends to accelerate during the second half of the path of the upper thread about the bobbin carrier.

To take account of this phenomenon, the second embodiment, shown in FIGS. 4 to 8, is provided with a cam 31 having two different cam profiles 29, 30 controlling the retraction of two different groups of pins 3.

In this second embodiment, a bobbin carrier 1 is, as before, suspended in a surrounding plate 2 by means of four pins 3 passing through and on either side of an annular space 4 in radial bores of bobbin carrier 1 and plate 2. Lever units 21, 22 are pivotally mounted in the surrounding plate 2 in the vicinity of the respective pins 3 to which they are pivotally connected by one lever arm 23. Another arm 24 of each lever unit 21, 22 is connected to a biasing spring 25 tending to retract the respective pin 3 into plate 2. A third arm 26, 27 of the respective lever units 21, 22 terminates with a cam follower 28 in contact with a respective one of the two cam profiles 29, 30 which are disposed externally on the periphery of cam 31 fixed on a coaxial driving pinion 7 meshing with a worm screw 8 driven by the principal shaft of the machine.

Figure 5:
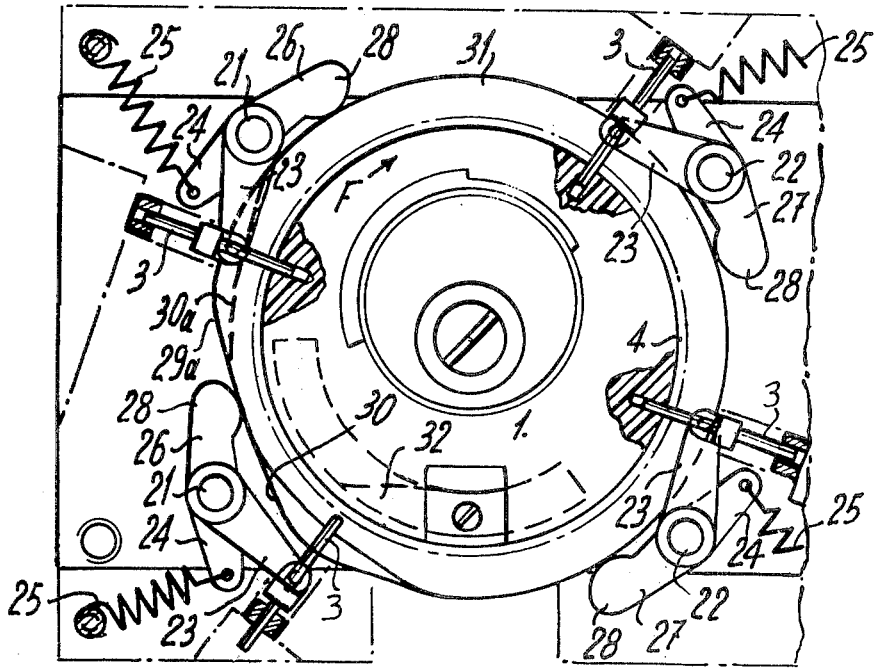
FIGS. 5 and 6 are top plan views partly cut-away and in cross-section respectively along lines V—V and VI—VI of FIG. 4.

A part 29*a* of the upper cam profile 29 cooperates with the cam follower 28 of lever units 21 to successively withdraw the pins 3 from a first part of the annular space 4 in which the upper thread is driven by a rotary hook 32 mounted on cam 31 and turning therewith in the direction of arrow F (FIG. 5).

A part 30*a* of the lower cam profile 30 cooperates with the cam follower 28 of lever units 22 to successively withdraw the pins 3 from a second part of the annular space 4 to allow passage of the upper thread.

Figure 6:
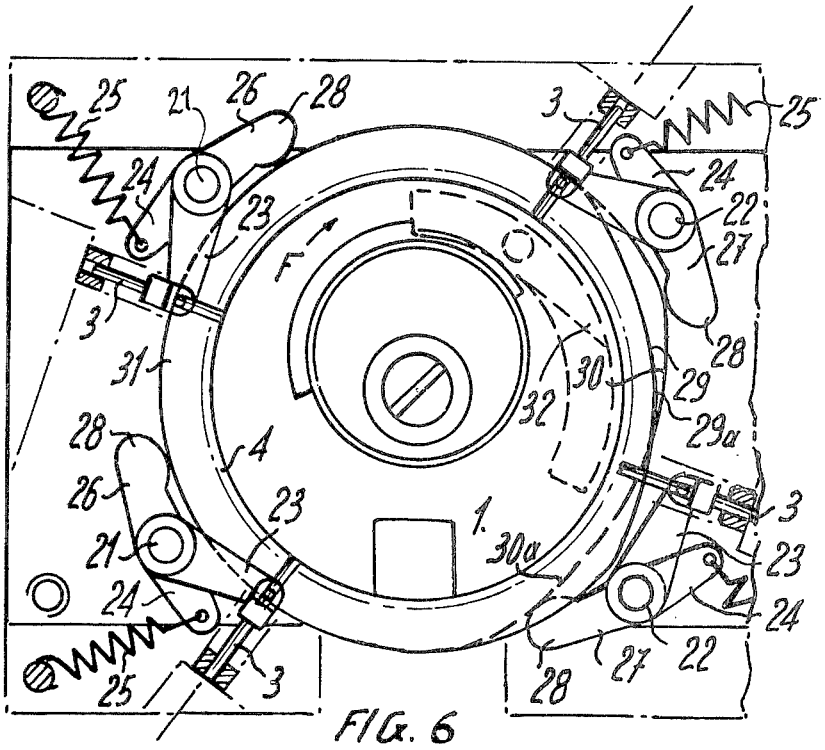
Figure 7:
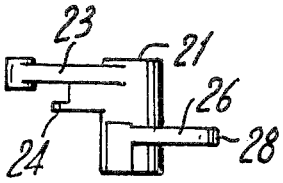
FIGS. 7 and 8 are elevational views of details of the device of FIGS. 4 to 6.
Figure 8:
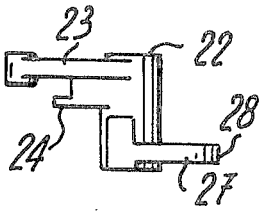

As shown in FIG. 6, part 30*a* of the lower cam profile 30 is phased in advance of part 29*a* of the upper cam profile 29 along the direction of rotation F of cam 31. Consequently, part 30*a* produces retraction of the pins 3 of the second part of space 4 with a relative phase advance, compared to retraction of the pins 3 from the first part of space 4.

Numerous variations of the illustrated embodiments of the invention can be envisaged.

The cam 31 with two cam profiles 29, 30 could, for example, be replaced by two cams coaxially mounted on the driving pinion 7 and each having a respective cam profile 29, 30. This arrangement could be such as to allow an angular adjustment of one of the cams relative to the other.

It is also possible to provide a lesser or greater number of pins 3 (for example, three or six pins 3) as joining elements between the bobbin carrier of the machine and its surrounding plate.

It would also be possible to provide a separate control cam for each lever unit (FIGS. 4 to 8) to individually control the withdrawal of the pins 3. These cams will preferably be coaxially mounted on the driving pinion 7 in a manner permitting setting of the relative angular positions of the cams.

The pins 3 of the first embodiment could be replaced by levers pivotally mounted on one of the two constituent pieces, namely the bobbin carrier 1 or its surrounding plate 2, one of the arms of each lever being actuated by the cam profile 10 to engage its other arm in the other piece, or to disengage it therefrom.

Instead of being controlled by a cam or cams, retraction of the joining elements 3 could be achieved by other means, for example electromagnetically.

In some cases the element passing in the space comprised between such pieces may itself provoke the actuation of such mechanical electronical or electromagnetic control means.

In other applications of the device, for example spinning or wire-drawing machines, the pins 3 could be retractably mounted in the central piece 1, and the member for controlling the position of the pins 3 could be a cam acting on the inner ends of the pins.

I claim:

1. In a sewing machine, the combination with a needle hole plate, a bobbin carrier, a plate member fixed to the lower part of the frame of the sewing machine beneath said needle hole plate and having an opening surrounding said bobbin carrier, of means for suspending said bobbin carrier within said plate member surrounding it, said means comprising connecting elements mounted in said plate member, means normally holding said elements retracted within said plate member, a cam barrier beneath said plate member and said bobbin carrier, cam means on said cam carrier facing one end of said connecting elements and normally holding the other end of said elements in engagement with said bobbin carrier, a hook attached to said cam carrier, means for rotating said cam carrier and hook to momentarily and successively retract said connecting elements from said bobbin carrier in synchronization with the driving of a loop of the upper thread around the bobbin carrier and produce engagement of the upper thread with a lower thread fed from a bobbin in the bobbin carrier for the formation of a stitch.

2. The combination according to claim 1 wherein said plate member and said bobbin carrier are each provided with oppositely facing radial bores and said connecting elements comprise pins longitudinally slidable into and out of related bores.

3. The combination according to claim 2 wherein said connecting elements comprise at least three pins longitudinally slidable into and out of related bores.

4. The combination according to claim 2 wherein said cam means comprises at least two different cam profiles controlling movement of two different groups of said connecting elements.

5. The combination according to claim 4 including control levers connected to each of said pins.

6. The combination according to claim 5, wherein said control levers are pivotally mounted on said plate member and are also connected to said means which normally hold said pins retracted within said plate member.

7. The combination according to claim 6, wherein said control levers each include a cam follower in contact with a respective one of said cam profiles.

* * * * *